US006845569B1

(12) United States Patent
Kim

(10) Patent No.: US 6,845,569 B1
(45) Date of Patent: Jan. 25, 2005

(54) SHOE DRYING APPARATUS

(76) Inventor: Soo Kil Kim, 687 Rivermill Pkwy., Wheeling, IL (US) 60090

( * ) Notice: Subject to any disclaimer, the term of this patent is extended or adjusted under 35 U.S.C. 154(b) by 0 days.

(21) Appl. No.: 10/787,840

(22) Filed: Feb. 25, 2004

(51) Int. Cl.[7] ..... F26B 25/00
(52) U.S. Cl. ..... 34/106; 34/202; 34/219
(58) Field of Search ..... 34/104, 105, 106, 34/201, 202, 218, 219

(56) References Cited

U.S. PATENT DOCUMENTS

| | | | | | |
|---|---|---|---|---|---|
| 3,793,744 | A | * | 2/1974 | Saita | 34/104 |
| 5,222,308 | A | * | 6/1993 | Barker et al. | 34/104 |
| 5,666,743 | A | * | 9/1997 | Dawson | 34/219 |
| 6,085,436 | A | * | 7/2000 | Peet | 34/104 |
| 6,134,806 | A | * | 10/2000 | Dhaemers | 34/404 |
| 6,591,517 | B1 | * | 7/2003 | Moore | 34/104 |

* cited by examiner

*Primary Examiner*—Stephen Gravini
(74) *Attorney, Agent, or Firm*—Ladas & Parry LLP

(57) ABSTRACT

The present invention provides a new and improved shoe drying apparatus that can dry washed and/or unwashed shoes in a short period of time by circulating ozone-containing air in the airtight interior of the apparatus and also deodorize and sanitize shoes by removing odor and bacteria from the shoes. The shoe drying apparatus comprises a housing having a front door, a first porous plate installed in the bottom interior of the housing, a sanitizing-deodorizing assembly for generating ozone-containing air ("mixed air"), a second porous plate installed in the top interior of the housing, a ventilating fan for dispersing the mixed air into the central interior of the housing, an intake fan for bringing back air present in the upper space of the second plate to the sanitizing-deodorizing assembly, a plurality of hollow main conduits extending vertically from the second plate to the first plate, a plurality of hollow auxiliary conduits extending horizontally from each main conduit, and a shoe-holding member on which a shoe is fixed for drying.

9 Claims, 6 Drawing Sheets

SHOE DRYING APPARATUS

BACKGROUND OF THE INVENTION

1. Field of the Invention

The present invention relates to a shoe drying apparatus, and more particularly an apparatus of which the interior is airtight when a front door is closed and in which the ozone-containing air is blown into the central space of housing by an air blower and then the air is circulated within the airtight interior by a ventilating fan and an intake fan installed on the upper space of housing, respectively, to deodorize and sanitize as well as dry the outer and inner surfaces of shoes, simultaneously.

2. Description of the Prior Art

In general, shoes after washing are allowed to be dried in the sun or the shade. Such natural drying way is however not appropriate in cold, wet or inclement weather and is also difficult to use for the complete removal of bacteria and odor present in shoes.

In order to settle these problems, an alternative way is often used of putting shoes into a clothes dryer for drying garments, for example, a coin laundry clothes dryer, so that the shoes are artificially dried. However, this alternative way is not desired because clothes dryers are usually set to the condition suitable for drying clothes but not for drying shoes, thus it is difficult to completely dry the inner and outer surfaces of a shoe by using this way. Moreover, according to this way, it takes many times to complete drying of shoes and the shoe material may also be deteriorated.

Therefore, some drying apparatuses only for shoes have been developed but they have some problems; for examples, uniform drying cannot be accomplished because of the substantial difference of airflow in the top and bottom interiors thereof, a big noise is generated by operation of air intake or discharge fans, and the like.

In recent, as the number of public facilities increases, the public health is further emphasized at these places, thus there is the need for deodorizing and sanitizing shoes which people visiting the public facilities wear. Moreover, as the number of single persons such as bachelor and spinster increases, the need for electric appliances for them such as coin laundry clothes dryer increases together. In particular, an apparatus for washing and/or post-treatment (drying, deodorization, sterilization) of shoes is required which can be used together while using clothes washing machine.

SUMMARY OF THE INVENTION

It is therefore an object of the present invention to provide a new and improved shoe drying apparatus that can dry washed and/or unwashed shoes in a short period of time by circulating ozone-containing air in the airtight interior of the apparatus. The apparatus can also deodorize and sanitize shoes by removing odor and bacteria therefrom.

A shoe drying apparatus according to the present invention comprises:

- a housing having a front door, the interior of the housing becoming airtight when the front door is closed;
- a first plate having a plurality of small piercing holes and being installed in the bottom interior of the housing;
- a sanitizing-deodorizing assembly for generating ozone-containing air ("mixed air") and sending it upward, the assembly being installed below the first plate;
- a second plate having a plurality of small piercing holes and being installed in the top interior of the housing;

- a ventilating fan for dispersing the mixed air into the central interior of the housing, the ventilating fan being installed on the second plate;
- an intake fan for bringing back air present in the upper space of the second plate to the sanitizing-deodorizing assembly, the intake fan being installed above the second plate and in air communication with a circulating duct of being formed vertically along the inner wall of the housing and extending below the first plate;
- a plurality of hollow main conduits extending vertically from the second plate to the first plate, each main conduit being in air communication with the upper space of the second plate;
- a plurality of hollow auxiliary conduits extending horizontally from each main conduit, each auxiliary conduit being in air communication with the main conduit; and
- a shoe-holding member on which a shoe is fixed for drying, the shoe-holding member being attached to the end of auxiliary conduit.

In the shoe drying apparatus according to the present invention, the ozone-containing air or the mixed air generated from the sanitizing-deodorizing assembly is dispersed into the central interior of the housing, i.e., the space between the first plate and second plate, then some thereof moves through the main conduit and through the auxiliary conduit toward the shoe-holding member, and other comes through the circulating duct back to the sanitizing-deodorizing assembly. In other words, the mixed air generally moves from the bottom to the top of the housing and, after performance of shoe drying, comes back to the bottom of housing. During such circulation, shoes which are fixed on the shoe-holding member can be dried, sanitized and deodorized under an appropriate condition.

In an embodiment, the first plate is installed in the top interior of housing and the second plate is installed in the bottom interior of the housing. In this embodiment, the sanitizing-deodorizing assembly is located above the first plate, thus the circulation direction of the mixed air is opposed to that of the above-described configuration.

The mixed air passing through the main conduit has a relatively high air pressure at the point near to the second plate; however, as some mixed air leaks out through auxiliary conduits while the mixed air moves downward, the air pressure is gradually reduced. As such, if the inner diameters of all auxiliary conduits are the same, the air pressures inside these auxiliary conduits will become different, which causes the drying condition for each shoe to become different, for example, different drying times to each other. Accordingly, it is preferable to make the inner diameters of auxiliary conduits to become gradually larger at the direction where the mixed air goes through the main conduit.

The configuration of the shoe-holding member which is attached to the end of auxiliary conduit is not particularly limited so long as it can fix a shoe stably thereto during operation of the apparatus. Preferably, the configuration of shoe-holding member may be of an elastically bended wire in which two wings are formed to secure holding of a shoe thereon, as seen in FIG. 1. In a preferable embodiment, the end of an auxiliary conduit is curvedly bended upward or downward to form a first spout, and the middle portion of the auxiliary conduit protrudes toward the bending direction of the end of the auxiliary conduit, in the shape of stub, in air communication with the auxiliary conduit, to form a second spout, and a shoe-holding member is attached to the first spout and/or second spout.

Ozone contained in the mixed air is generated from an ozone lamp in the sanitizing-deodorizing assembly. In an embodiment, the mixed air may contain an anion air component as well as ozone for improvement of sanitizing and deodorizing functions in which the anion air component can be generated by a known anion air generator.

In an embodiment, a moisture absorption device is further included in the interior of housing so that the humidity can be maintained low thereby accomplishing a high drying rate. Such a moisture absorption device may be installed neighboring or in the sanitizing-deodorizing assembly. Moisture collected in the device is at a high contamination level and may become a source for a nasty smell and the propagation of bacteria. As such, where the moisture absorption device is included in the shoe drying apparatus of the present invention, it is preferable to further install a separate device for discharging the moisture outside the apparatus or include adsorbent for adsorption of bacteria or other harmful materials, such as zeolite, in the moisture absorption device.

The operation condition of the shoe drying apparatus according to the present invention, for example, operation time and temperature, can be determined by various parameters such as the dimension of apparatus, the number of shoes to be dried, etc. Preferably, the apparatus is set to be able to operate at 40~60° C. for 20~60 minutes, which is a particularly preferable operation condition for using the apparatus of the present invention for the purpose of drying, sanitizing and deodorizing shoes while a client carries out the washing and drying of garments, for example, with a coin laundry clothes dryer.

As the temperature of the housing interior increases, the amount of moisture evaporated from shoes also increases. However, according to experiments performed by the inventor of the present invention, the temperature of the housing interior increases rapidly up to 30° C. but the increasing rate of temperature significantly decreases at more than that temperature due to the latent heat of moisture for evaporation. Accordingly, it is more desirable that when the temperature of housing interior reaches about 30° C., some of a circulating air with a high humidity is discharged outside the housing, which allows the temperature of housing interior to readily reach the range of operation temperature as defined above. Therefore, in a preferable embodiment, a temperature sensor is installed at least in one site of the housing interior, and a fan which blows a circulating air from the lower space of the second plate toward the upper space thereof is further installed on the second plate, and an outlet is formed on the housing at the position thereof facing the fan. The temperature sensor is preferably positioned under the second plate. In order that air to be discharged through the outlet can predominantly be a circulating air blown directly from the lower space of the second plate by the fan, a cylindrical member with the open top end is installed on the fan for the intended induction of airflow.

The dimension of the apparatus according to the present invention is not particularly limited; however, where the apparatus is used together with a coin laundry clothes dryer, it can be made of the dimension of about 600~1400 nun length, about 300~1400 mm width and about 1200~2000 mm height to occupy a relatively small space.

BRIEF DESCRIPTION OF THE INVENTION

The present invention will be better understood and objects thereof will become apparent when consideration is given to the following detailed description thereof.

DESCRIPTION OF THE PREFERRED EMBODIMENT

A shoe drying apparatus according to an embodiment of the present invention is illustrated in FIGS. 1~4. A shoe drying apparatus is composed of a housing 10 being made of boards 10*a* including an adiabatic material 10*b* therebetween. The housing 10 has a door 20 at the front thereof, in which the door 20 also includes an adiabatic material 10*a*, whereby the interior of housing 10 can be effectively airtight and adiabatic when the door 20 is closed and also the heat loss of air circulating the interior of housing 10 can be minimized.

Figure 2:
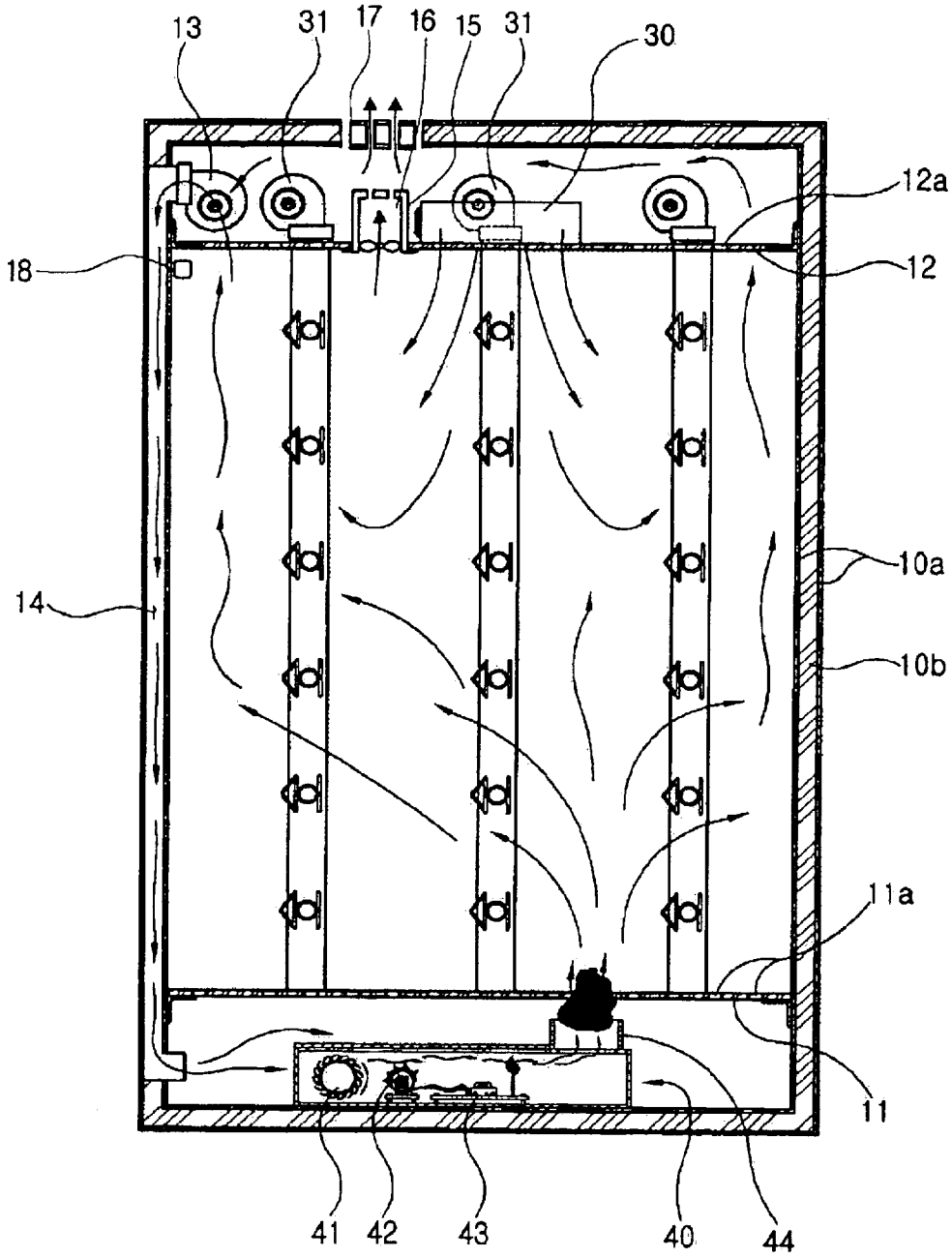
FIG. 2 is a front, cross-sectional view of the shoe drying apparatus as shown in FIG. 1.

Referring to FIG. 2, a fist plate 11 is installed in the bottom interior of housing 10 and has a plurality of small piercing holes 11*a* through which an ozone-containing air can go upward. Below the first plate 11 are positioned a sanitizing-deodorizing assembly comprising an air blower 41, an ozone lamp 42, an anion air generator 43 and an air discharge duct 44. The sanitizing-deodorizing assembly 40 serves to generate a circulating air containing ozone and anion air component, i.e., mixed air and send it toward the central interior of housing 10. More particularly, the air blower rotating at a high speed raises the wind and while the wind moves toward the discharge duct 44, ozone and anion air component created in the ozone lamp 42 and anion air generator 43 respectively are added thereto. The mixed air prepared thus moves toward the central interior of housing 10 to remove bacteria and bad smell present in shoes 50 and evaporate moisture therefrom. As described previously, the anion air generator 43 may be skipped.

Referring still to FIG. 2, a second plate 12 is installed in the top interior of housing 10 and has a plurality of small piercing holes 12*a* through which a circulating air can pass. A ventilating fan 30 and intake fan 13 are positioned on the second plate 12, respectively, in which the intake fan 13 is connected to an air circulation passage 14. The air circulation passage 14 is formed along the lateral wall of housing 10 through which the mixed air can move downward. More particularly, the mixed air moving upward by the sanitizing-deodorizing assembly 40 is drawn by the intake fan 13, after perforation of drying of shoes, to be discharged into the air circulation passage 14. Such air moves downward through the air circulation passage 14 to come back to the sanitizing-deodorizing assembly 40.

On a portion of the upper housing 10, formed is an outlet 17 through which some of air circulating in the housing interior can be discharged. Discharging some of a circulating air contributes to control of the relative humidity. However, because the outlet 17 consists of small holes, the naturally occurring discharge has a certain limit. Therefore, a fan 15 which forces air to move from the lower space of the second plate toward the upper space thereof is installed on the second plate 12 at the position facing the outlet 17 of housing 10. Moreover, the fan 15 is positioned inside a cylindrical member 16 with the top end thereof being open. Accordingly, the temperature of the housing interior is continuously checked by a temperature sensor 18 installed under the second plate 12, and when the temperature reaches a certain level, e.g., about 30° C., the fan 15 is operated to allow some of air circulating below the second plate 12 to move outside the housing 10 through the cylindrical member 16 and through the outlet 17. Although some of air being present above the second plate 12 may be discharged, the discharging air is predominantly air with a high humidity coming from the central interior of housing 10, i.e., the space below the second plate 12 by the compulsory blow of the fan 15. This configuration has another advantage of not making big noise because all fans including the fan 15 are placed inside the housing 10.

Figure 3:
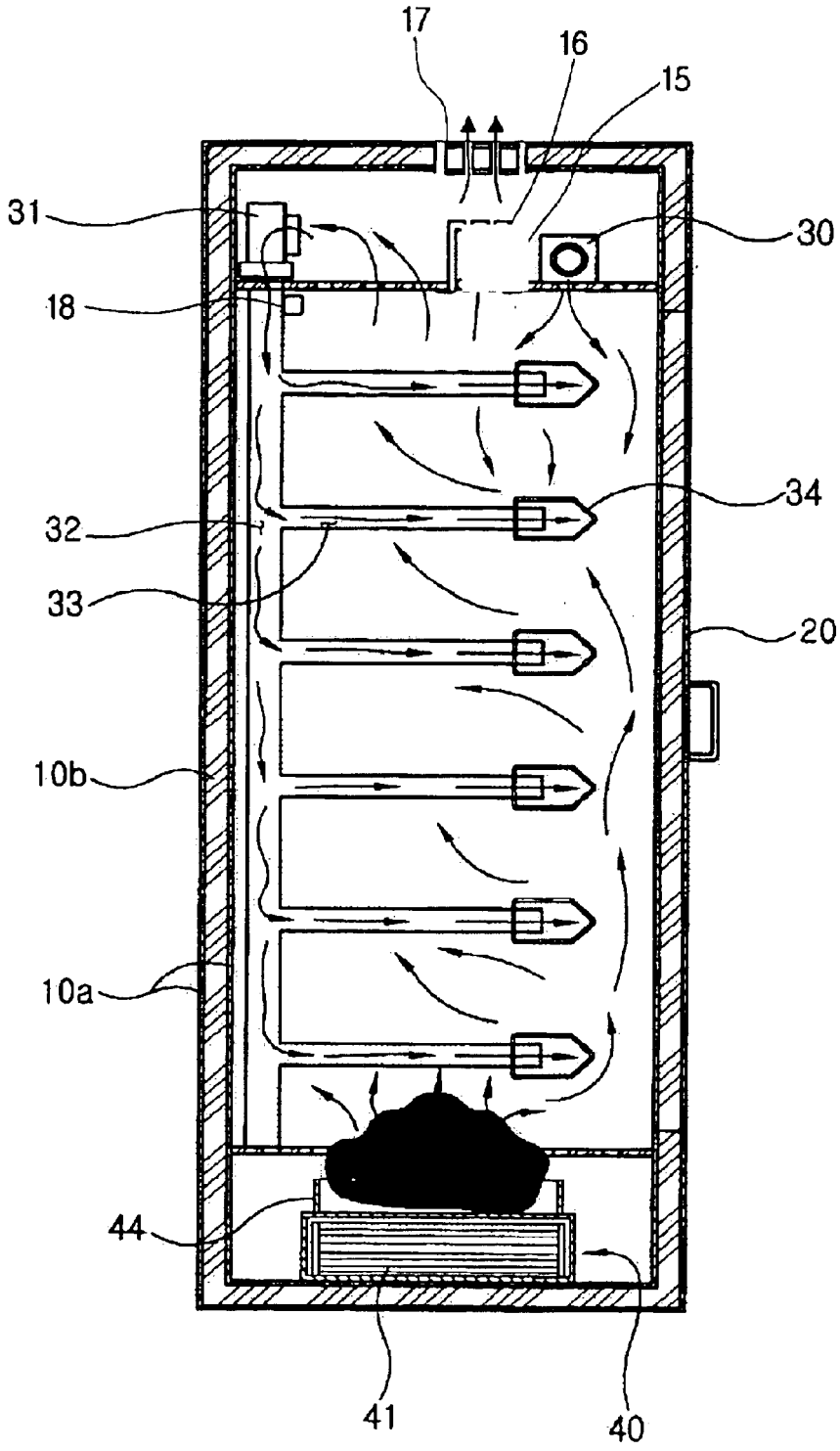
FIG. 3 is a right, cross-sectional view of the shoe drying apparatus as shown in FIG. 1.

Referring now to FIG. 3, an intake fan 31 which is placed on the second plate 12 is connected to a hollow main conduit 32. The main conduit 32 extends vertically up to the first plate positioned in the bottom interior of housing and a plurality of hollow auxiliary conduits 33 extend horizontally from each main conduit 32 in air communication therewith A shoe-holding member 34 is attached to the end of auxiliary conduit 33. The intake fan 31, main conduit 32 and auxiliary conduit 33 together serve to draw the mixed air originating from the sanitizing-deodorizing assembly 40 and move it toward the shoe-holding member 34, thereby drying, sanitizing and deodorizing the inner surface of shoes fixed on the shoe-holding member 34.

As seen in FIGS. 2 and 3, a ventilating fan 30 installed on the second plate 12 serves to disperse air come from the bottom of housing 10 into the central interior of housing 10 to dry, sanitize and deodorize the outer surface of shoes fixed on the shoe-holding member 34.

Figure 4:
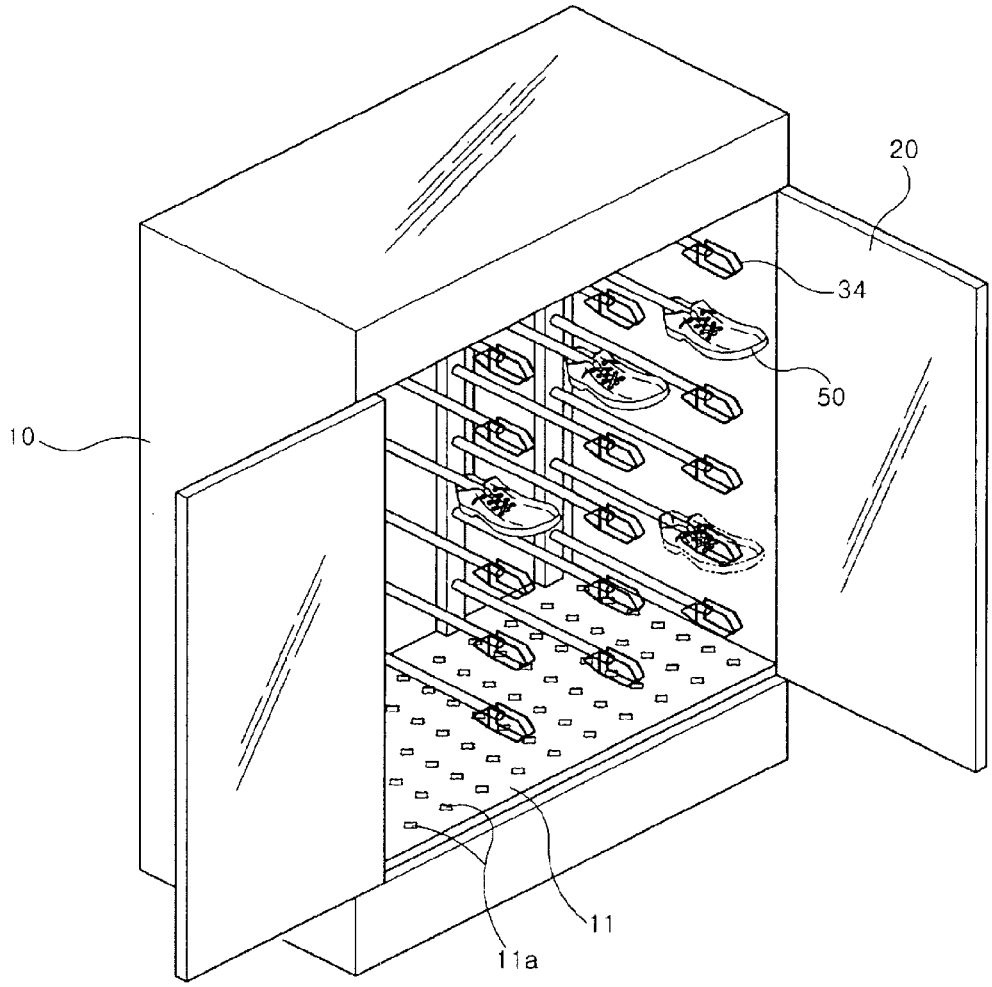
FIG. 4 is a perspective view of the shoe drying apparatus as shown in FIG. 1 in which several shoes are fixed on shoe-holding members.

Referring next to FIG. 4, shoes 50 are fixed on shoe-holding members 34 and a front door 20 closed, then a sanitizing-deodorizing assembly (not shown) is operated. The mixed air generated from the sanitizing-deodorizing assembly is blown upward through holes 11*a* of a first plate 11 to perform drying, sanitizing and deodorizing of the shoes 50 within the airtight interior of housing 10.

Referring again to FIGS. 2 and 3, some of the mixed air moved into the interior of housing 10 is also dispersed into the central interior of housing 10 by the ventilating fan 30 to dry the outer surface of shoes and other air is drawn into the air circulation passage 14 to come back to the sanitizing-deodorizing assembly 40. This circulation continually repeats while the apparatus is operating.

In addition, another some of the mixed air moved into the interior of housing 10 is drawn into the main conduit 32 by the intake fan 31 to move to the auxiliary conduit 33, connected to the lateral side of the main conduit 32 in air communication therewith, and then be discharged inside the shoe 50 fixed on the shoe-holding member 34.

The shoe drying apparatus of such configuration according to the present invention can also be applied to drying, sanitizing and deodorizing of shoes for which water washing cannot be carried out and running shoes prior to water washing. Shoes and running shoes having been worn for a long time are usually under an unsanitary condition, e.g., being soaked through with perspiration and stinking. But this condition can be recovered to a pleasant and sanitary condition by fixing these shoes or running shoes on the shoe-holding member 34 and then operating the sanitizing-deodorizing assembly 40 to remove bacteria and odor being present in the shoes.

Figure 1:
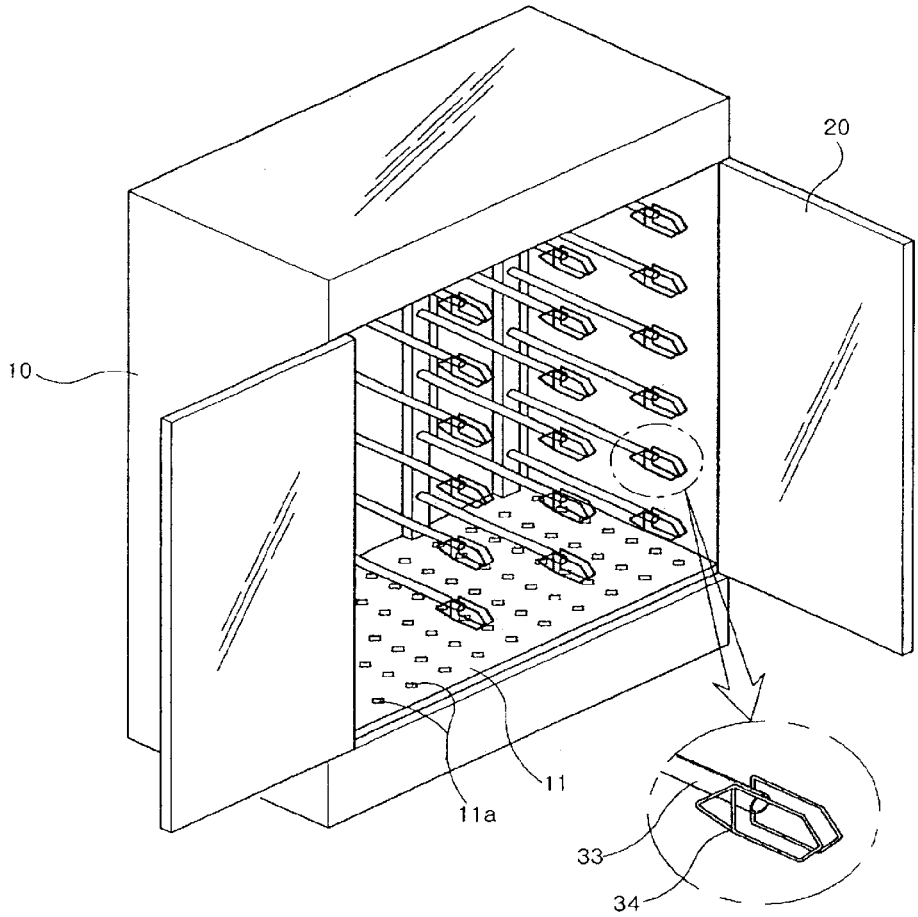
FIG. 1 is a perspective view of a shoe drying apparatus according to an embodiment of the present invention, with a partial enlarged view of a shoe-holding member, in which a front door is open.
Figure 5:
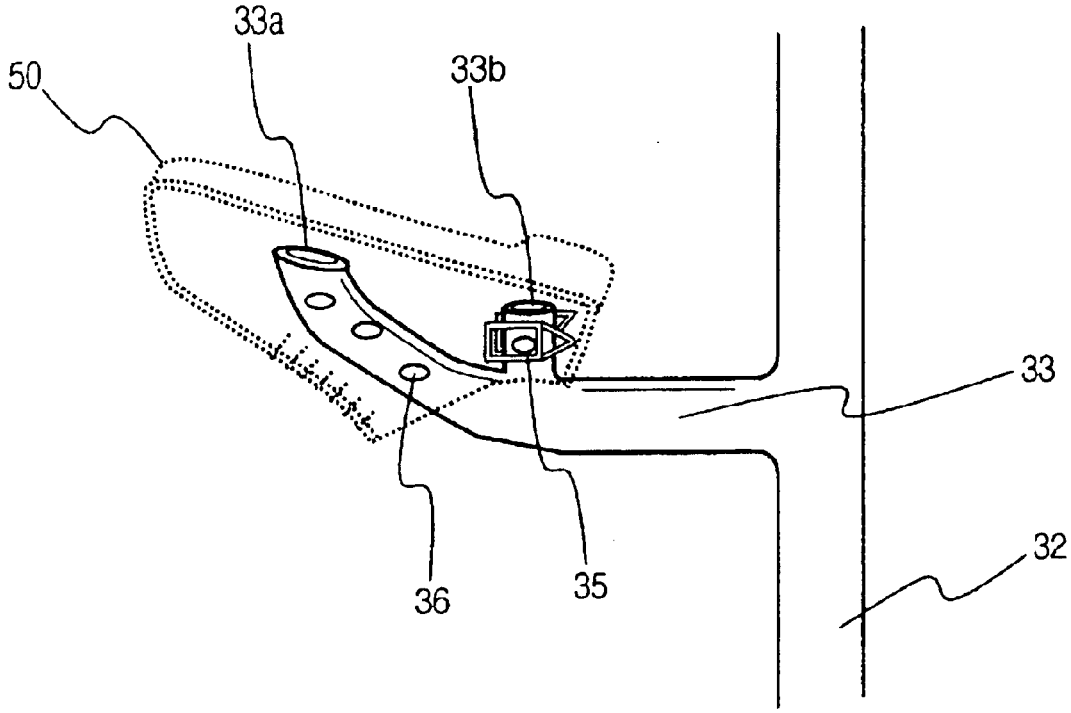
FIG. 5 is a perspective view of an auxiliary conduit according to another embodiment which can be used in a shoe drying apparatus of the present invention, in which a shoe is fixed on the end of the conduit and a stub extending therefrom.

In FIG. 5 illustrated is another configuration of an auxiliary conduit useful to a shoe drying apparatus according to the present invention. Referring to FIG. 5, the end of an auxiliary conduit 33 that extends horizontally from a main conduit 32 is curvedly bended upward to form a first spout 33*a*, and the middle portion of the auxiliary conduit 33 protrudes in the shape of stub to form a second spout 33*b*. An engagement means 35 for fixing a shoe 50 on the auxiliary conduit 33 is attached to the second spout 33*b*. The engagement means 35 is practically identical to the shoe-holding member 34 as seen in FIG. 1. Accordingly, the shoe 50 is put on both spouts 33*a*, 33*b* of the auxiliary conduit 33 and securely fixed thereon by the engagement means 35. Moreover, the auxiliary conduit 33 is pierced at its portion which is covered by the shoe 50 to form a plurality of holes 36. The mixed air introduced through the main conduit 32 moves through the auxiliary conduit 33 toward the end thereof to be discharged from the first and second spouts 33*a*, 33*b* inside the shoe 50. In another embodiment, the auxiliary conduit 33 is configured with both spouts 33*a*, 33*b* facing downward and in this configuration, the shoe 50 is fixed on the auxiliary conduit 33 as opposed to the direction in FIG. 5.

Figure 6:
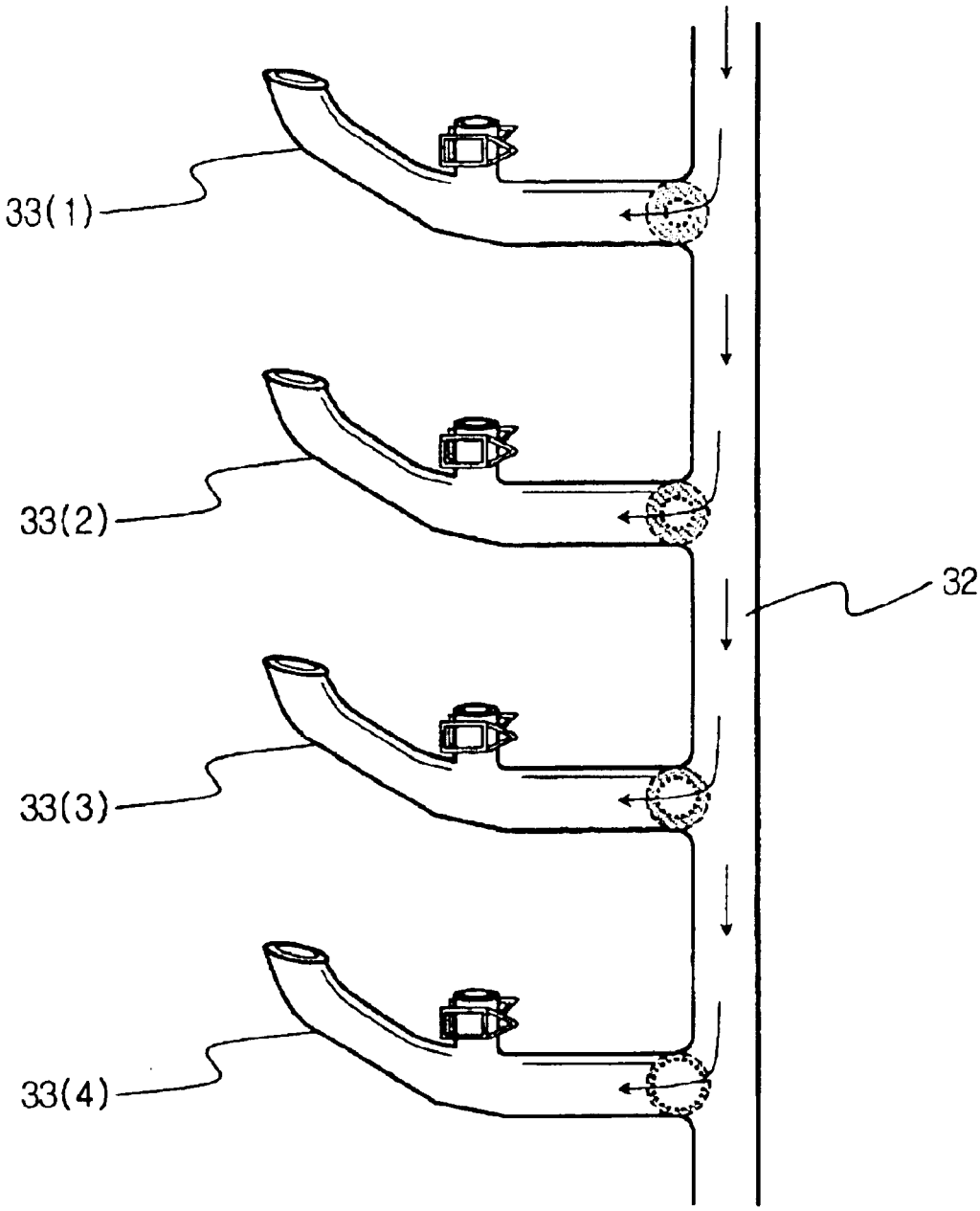
FIG. 6 is a perspective view of a main conduit and a plurality of auxiliary conduits extending horizontally therefrom, which shows the inner diameters of these auxiliary conduits.

In FIG. 6 illustrated is another configuration of a main conduit and auxiliary conduit useful to a shoe drying apparatus according to the present invention. Referring to FIG. 6, a plurality of auxiliary conduits 33(1), 33(2), 33(3), 33(4) extending horizontally from a main conduit 32 have different inner diameters. More particularly, where the mixed air moves downward, the inner diameter of the top auxiliary conduit 33(1) is smaller than that of the bottom auxiliary conduit 33(4), and the inner diameters of the auxiliary conduits 33(2) and 33(3) between the top and bottom conduits 33(1), 33(4) become gradually larger as these conduits 33(2), 33(3) are positioned downward. As a result, although the air pressure gradually decreases while the mixed air moves downward, the amounts of the mixed air discharging toward the auxiliary conduits 33(1), 33(2), 33(3), 33(4) are practically the same due to the gradual decrease of inner diameters thereof, which allows shoes to be dried within the approximately same time regardless of the height of auxiliary conduits.

While a preferred embodiment of the shoe drying apparatus according to the present invention has been described in detail, it should be apparent that modifications and variations thereto are possible, all of which fall within the true spirit and scope of the present invention. With respect to the above description then, it is to be realized that the optimum dimensional relationships for the parts of the present invention, to include variation in size, materials shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the present invention. Further, since numerous modifications and changes will readily occur to those skilled in the art, it is not desired to limit the present invention to the exact construction and operation shown and described, and accordingly, all suitable modifications and equivalents may be resorted to, falling within the scope of the present invention.

What is claimed is:

1. A shoe drying apparatus comprising:

a housing having a front door, the interior of the housing becoming airtight when the front door is closed;

a first plate having a plurality of small piercing holes and being installed in the bottom interior of the housing;

a sanitizing-deodorizing assembly for generating ozone-containing air ("mixed air") and sending it upward, the assembly being installed below the first plate;

a second plate having a plurality of small piercing holes and being installed in the top interior of the housing;

a ventilating fan for dispersing the mixed air into the central interior of the housing, the ventilating fan being installed on the second plate;

an intake fan for bringing back air present in the upper space of the second plate to the sanitizing-deodorizing assembly, the intake fan being installed above the second plate and in air communication with a circulating duct of being formed vertically along the inner wall of the housing and extending below the first plate;

a plurality of hollow main conduits extending vertically from the second plate to the first plate, each main conduit being in air communication with the upper space of the second plate;

a plurality of hollow auxiliary conduits extending horizontally from each main conduit, each auxiliary conduit being in air communication with the main conduit; and a shoe-holding member on which a shoe is fixed for drying, the shoe-holding member being attached to the end of auxiliary conduit.

2. The shoe drying apparatus according to claim 1, wherein the inner diameters of the auxiliary conduits are adjusted to become gradually larger at the direction where the mixed air goes through the main conduit.

3. The shoe drying apparatus according to claim 1, wherein the end of the auxiliary conduit is curvedly bended upward or downward to form a first spout, and the middle portion of the auxiliary conduit protrudes toward the bending direction of the end of the auxiliary conduit, in the shape of stub, in air communication with the auxiliary conduit, to form a second spout, and the shoe-holding member is attached to the first spout and/or second spout.

4. The shoe drying apparatus according to claim 1, wherein the apparatus further includes a moisture absorption device near or in the sanitizing-deodorizing assembly.

5. The shoe drying apparatus according to claim 4, wherein the moisture absorption device includes zeolite for adsorption of bacteria and other harmful materials present in the moisture collected by the device.

6. The shoe drying apparatus according to claim 1, wherein the apparatus is set to operate at 40~60° C. for 20~60 minutes to dry, deodorize and sanitize shoes.

7. The shoe drying apparatus according to claim 1, wherein a temperature sensor is installed at least in one site of the housing interior, and a fan which blows a circulating air from the lower space of the second plate toward the upper space thereof is further installed on the second plate, and an outlet is formed on the housing at the position thereof facing the fan.

8. The shoe drying apparatus according to claim 7, wherein the temperature sensor is installed under the second plate, and the fan is installed in a cylindrical member with the open top end, the cylindrical member extending upward from the second plate.

9. The shoe drying apparatus according to claim 7, wherein the fan is operated when the temperature of housing interior reaches about 30° C.

* * * * *